US006360505B1

(12) United States Patent
Johns

(10) Patent No.: US 6,360,505 B1
(45) Date of Patent: Mar. 26, 2002

(54) SURFACE PANEL AND ASSOCIATED ICF SYSTEM FOR CREATING DECORATIVE AND UTILITARIAN SURFACES ON CONCRETE STRUCTURES

(75) Inventor: William A. Johns, Folsom, CA (US)

(73) Assignee: Michael Boynoff, Santa Clara, CA (US)

( * ) Notice: Subject to any disclaimer, the term of this patent is extended or adjusted under 35 U.S.C. 154(b) by 0 days.

(21) Appl. No.: 09/389,725

(22) Filed: Sep. 3, 1999

Related U.S. Application Data

(60) Provisional application No. 60/099,164, filed on Sep. 4, 1998.

(51) Int. Cl.[7] ..... E04F 13/14

(52) U.S. Cl. ..... 52/311.1; 52/426; 249/15

(58) Field of Search ..... 52/311.1, 311.3, 52/315, 329, 339, 341, 426, 439, 592.6; 249/14, 15, 16

(56) References Cited

U.S. PATENT DOCUMENTS 2,178,535 A * 10/1939 Willson ..... 249/15 X
4,407,104 A 10/1983 Francis
4,510,729 A 4/1985 Syring
4,956,949 A 9/1990 Francis
5,009,387 A * 4/1991 Scott et al. ..... 249/16 X
5,502,941 A 4/1996 Zember et al.
5,570,550 A * 11/1996 Roby ..... 52/426 X
5,845,445 A * 12/1998 Blackbeard ..... 52/426 X
5,896,714 A 4/1999 Cymbala et al.
5,992,114 A * 11/1999 Zelinsky et al. ..... 52/426
6,041,567 A * 3/2000 Passeno ..... 52/311.3

* cited by examiner

*Primary Examiner*—Peter M. Cuomo
*Assistant Examiner*—Michael J. Fisher
(74) *Attorney, Agent, or Firm*—Howard E. Lebowitz

(57) ABSTRACT

A surface panel for creating decorative and utilitarian motif surfaces on concrete structures is disclosed. This surface panel allows motif surfaces of brick, stone, tile or siding to be applied to the exterior and interior of concrete structures. The surface panel can be used with other surface panels, or alternatively, as a component of an insulating concrete form (ICF) system. When used with an ICF system, the exterior surface of a concrete structure has a motif surface of brick, stone, tile or siding, while the interior of the structure has an insulating polystyrene surface. The surface panel described herein allows concrete structures including buildings, walls, pillars, and stanchions to be built efficiently and without skilled labor.

18 Claims, 12 Drawing Sheets

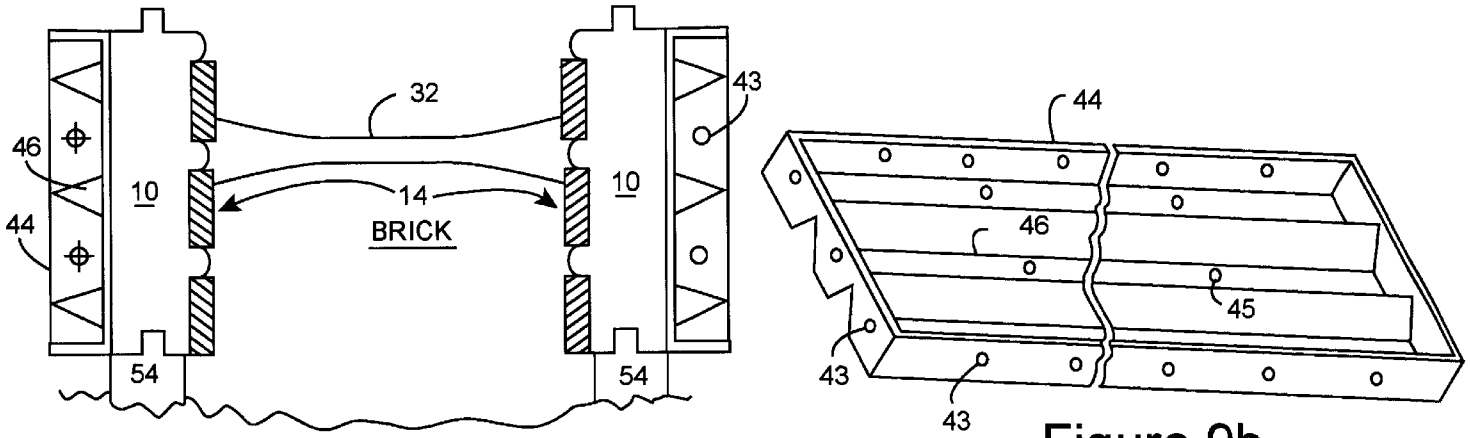
Figure 9b
Figure 9a
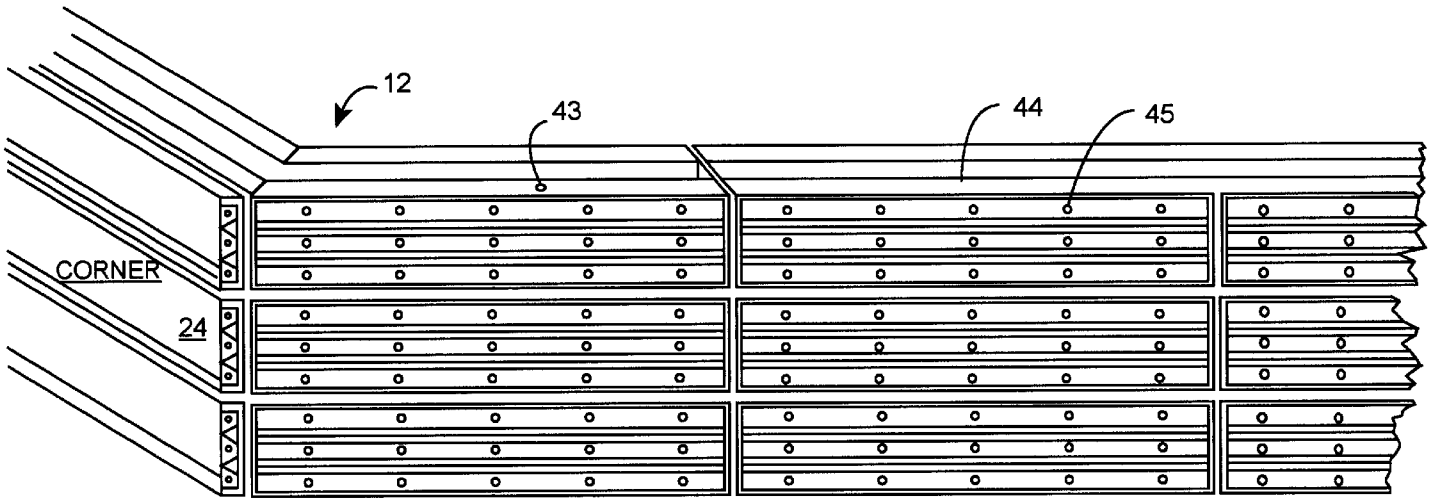
Figure 9c

SURFACE PANEL AND ASSOCIATED ICF SYSTEM FOR CREATING DECORATIVE AND UTILITARIAN SURFACES ON CONCRETE STRUCTURES

CROSS REFERENCE TO RELATED APPLICATIONS

This application claims the benefit of U.S. Provisional Application No. 60/099,164 filed on Sep. 4, 1998.

FIELD OF THE INVENTION

This invention pertains generally to building concrete walls and other concrete structures having stone, brick, tile or siding surfaces, and more specifically, to an apparatus which allows concrete structures having stone, brick, tile or siding surfaces to be efficiently built without skilled labor.

BACKGROUND

Brick has been used to build castles, houses, and commercial structures from early times, to present day. A drawback to using brick relates to its required use of highly skilled labor to properly build the brick outer walls of a structure. Brick masons are specialists in their field, are in high demand, and can charge premium prices for the work they perform, escalating the price of construction out of the reach of the majority of home buyers.

Due to expense of brick masonry, most entry-level and move-up homeowners gravitate towards alternative, and more affordable building materials such as wood and stucco structures, commonly referred to as "stick construction" in the building industry.

In recent years, the cost of stick construction has begun to increase rapidly, although it is still not yet near in price to solid brick construction. The driving force behind the increase in the cost of stick construction has been environmental restrictions on logging, which has driven up the cost of wood products, and additionally, the cost of disposal of wood waste from construction, which is significant. It is also likely that as future demand for new construction increases with increasing population, that the supply of wood products will not be able to meet this future demand, thereby driving the cost of stick construction up even beyond present day levels.

In an attempt to seek an alternative to stick construction, concrete has been used increasingly as a viable alternative building material. Although concrete is often perceived as gray and unaesthetic, this perception has changed in recent years with new technology, which allows concrete to be colored and formed in various aesthetic shapes. Concrete is also very cost effective and not given to high environmental costs since it can be manufactured from readily available abundant aggregates such as limestone, clay, and sand, which can be produced locally in most areas, thereby avoiding the significant transportation costs associated with lumber.

The technology which has developed around concrete building construction is designed to complement the existing positive aspects of concrete, and to add extra utility thereto. An example of such a technology is that produced by United Building Forms, Inc. of Santa Clara, Calif. United uses a stackable Polystyrene forms (called an Insulating Concrete Form, or "ICF") having two sides, and a plurality of permanent center "ribs" attaching the two sides and spanning across the interior of each ICF. The spaces separating the ribs comprise a plurality of through-holes within which reinforcing bar (rebar) can be set for adding strength to the concrete. Upon vertically stacking the ICFs, the through-holes match up and create a tunnel for placing the rebar. Each ICF is vertically stacked upon its predecessor, and interlocked upon its predecessor via tongue-in-groove coupling. When the concrete is poured and set, the ICFs remain in place, and cannot be removed, due mainly to the cross-ribs, which are now firmly set in the concrete. The opposite sides of the ICF create an insulating barrier, which creates an R-20 insulating factor. This level of insulation can result in a 50 per cent savings in energy costs over conventional stick construction.

Once the ICF walls are in place, their Polystyrene exterior is fully visible, even though their cores are comprised of solidified concrete. The result is a highly-insulated, nearly indestructible wall, which can then be finished into a structure by adding a roof, electrical, plumbing, and landscaping. The ICF system used by United Building Forms also reduces the amount of labor required to build a typical house or other structure, and additionally, requires only low-skilled laborers to construct, thereby reducing labor costs significantly.

The exterior of the ICF walls can be painted, stuccoed, or else have a brick or stone veneer glued to the exterior, to give the appearance of a solid brick or stone structure. Although this step can give a house the appearance of a brick structure, it is nevertheless still a mere veneer, and not a solid brick wall, having all the quality and solidity associated therewith.

Typical veneer systems are seen in U.S. Pat. Nos. 4,407,104 and 4,956,949 which disclose polystyrene and brick veneer systems which allow an exterior surface of bricks to be attached to a stick built structure. The bricks are attached with clips to polystyrene panels, which are then hung in place upon a stick structure.

While the prior art discloses various methods for hanging brick veneers on structures, none disclose a system for placing real brick, stone, tile or siding surfaces upon a structure without resorting to expensive masonry methods. Additionally, none of the prior art teach placing a real brick, stone, tile or siding surface onto a concrete structure. Therefore, a need exists whereby a non-veneer solid brick, stone, tile or siding-faced structure can be built inexpensively and preferably, from concrete. The present invention accomplishes these ends.

The foregoing discussion reflects the state of the art of which the inventor is aware, and is tendered with a view toward discharging the inventor's acknowledged duty of candor in disclosing information which may be pertinent with regards to the patentability of the present invention. It is respectfully stipulated, however, that the disclosed patents and other information do not teach or render obvious, singly or when considered in combination, the inventor's claimed invention.

SUMMARY OF THE INVENTION

The present invention relates to a "surface panel", which allows a decorative and utilitarian brick, stone, tile or siding motif surface to be incorporated into a concrete structure. The individual bricks, stones, tiles or siding pieces and their equivalents, will collectively be termed "motif components", herein. The surface panel described herein can be used with or without an ICF system, however, the advantages of using this panel in conjunction with an ICF system will be stressed. The surface panel is preferably made from polystyrene due to its light weight and durable quality.

By itself, the surface panel has a plurality of recessed bordered regions with raised borders, for placing bricks, stone, tile, siding or any other type of motif component. The bordered regions are preferably sized and shaped to snugly engage the motif components and hold them within the bordered regions via a friction fit. When positioned in the border regions, each motif component protrudes above the raised border a distance substantial enough to expose sufficient surface area to a concrete pour, so as to embed the exposed area of the motif component into the concrete, upon drying. The concrete serves as a mortar for holding the motif components solidly embedded into the concrete. Upon removing the surface panel, the result is a concrete structure having a uniform surface of brick, stone, tile or siding. Also, while concrete is mentioned as the preferred pourable mortar herein, any pourable mortar or binder which holds the motif components within a finished structure could be used.

The surface panel is designed to be one side of a concrete form well, the opposite side of the form well is comprised on an "interior panel". This interior panel can be another surface panel containing motif components, a plywood panel, or a polystyrene ICF panel. The surface panel fastens to the interior panel, completing the form well, which is filled with a pourable concrete mixture. A plurality of fasteners span the well and hold the surface panel and interior panel in place during a concrete pour, and subsequent drying of the concrete. The fasteners include spacers which separate the surface panel and interior panel, these spacers being designed to become part of the concrete structure and remain embedded in the concrete for attaching wall components, cabinets, and the like. Additionally, these spacers can be used to attach scaffolding to build higher concrete walls.

This invention also comprises an ICF system which uses the surface panel and has an insulating polystyrene interior panel. In one embodiment, this invention relates to an ICF having a modular character which allows a concrete wall to be built by stacking successive ICF's upon each other using an interlocking tongue-in-groove mechanism. The ICF system can also incorporate a plurality of pre-formed plastic support panels which are superior to plywood support panels presently in use.

Finally, this invention comprises a concrete structure as a product of the surface panel previously described. The versatility of the surface panel allows it to be used to build numerous concrete structures including but not limited to, walls, buildings, houses, columns, pillars, and stanchions.

As such, this invention seeks to achieve the following objects and advantages:

It is an object of this invention to provide an apparatus for incorporating real motif surfaces into concrete construction as an alternative to using veneer surfaces.

It is another object of this invention to provide an apparatus for incorporating motif surfaces into concrete construction using an ICF.

Still another object of this invention is to provide a more cost effective method for building real brick, stone, tile or siding structures which does not depend on the use of skilled labor.

Another object of this invention is to provide a method for building real brick, stone, tile or siding structures in a shorter length of time when compared with traditional masonry methods.

Further objects and advantages of the invention will be brought out in the following portions of the specification, wherein the detailed description is for the purpose of fully disclosing preferred embodiments of the invention, without placing limitations thereon.

BRIEF DESCRIPTION OF THE DRAWINGS

The invention will be more fully understood by reference to the following drawings which are for illustrative purposes only:

FIG. 9A is a cutaway end view of a pair of surface panels assembled for building a two-sided brick wall, this view showing plastic paneling attached for added support.

FIG. 9B is a perspective view of a plastic panel.

FIG. 9C is a side elevated perspective view of a pair of adjoining walls built with the ICF described herein and supported with a plastic paneling system.

DESCRIPTION OF THE PREFERRED EMBODIMENTS

Figure 1:
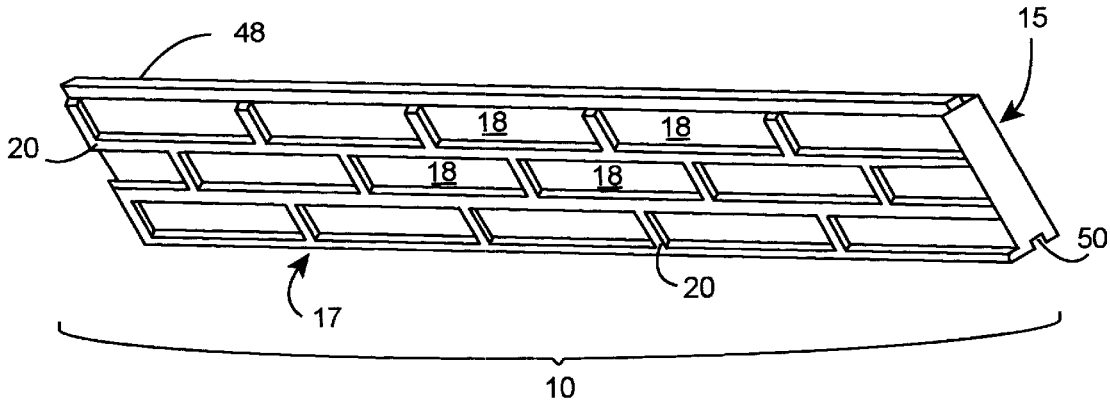
FIG. 1 is a side perspective view of a surface panel.

Referring more specifically to the drawings, for illustrative purposes, the present invention is embodied in the surface panel 10 shown in FIG. 1. This invention also comprises the use of this surface panel 10 in conjunction with an Insulating Concrete Form (ICF) 12 shown in FIGS. 2A–C. Finally, this invention also comprises a structure built using surface panel 10 described herein.

Figure 2A:
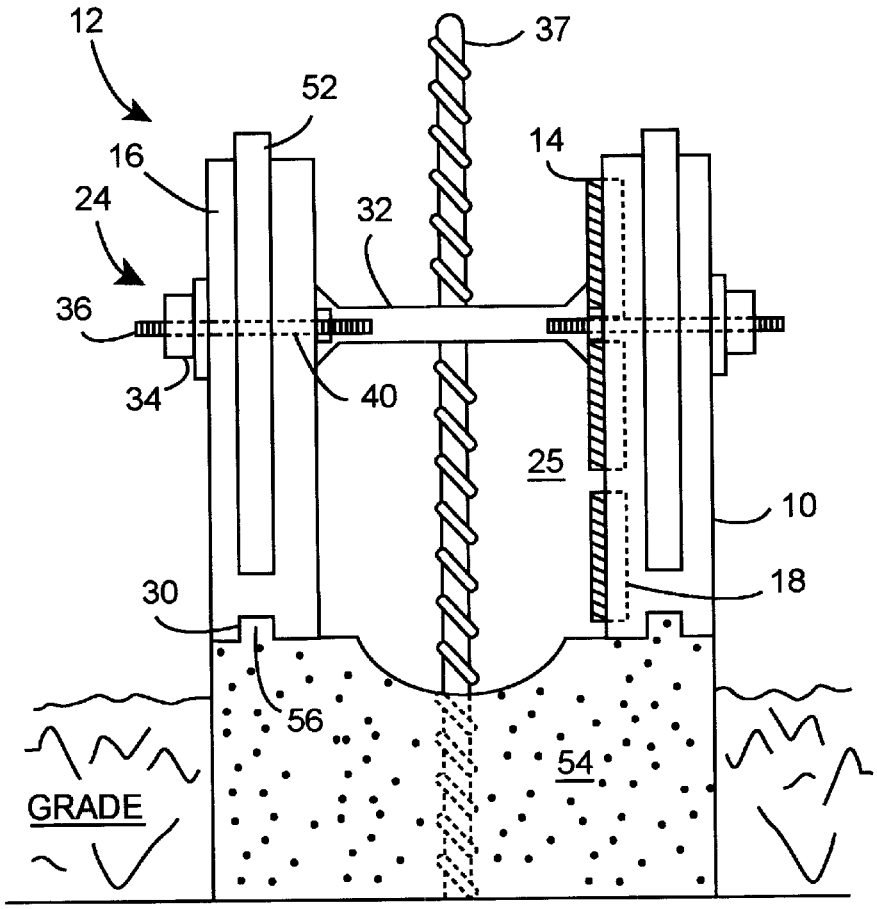
FIG. 2A is a cutaway end view of an ICF incorporating the surface panel shown in FIG. 1, this ICF defining a concrete form well and being positioned upon a concrete foundation prior to accepting a concrete pour.
Figure 2B:
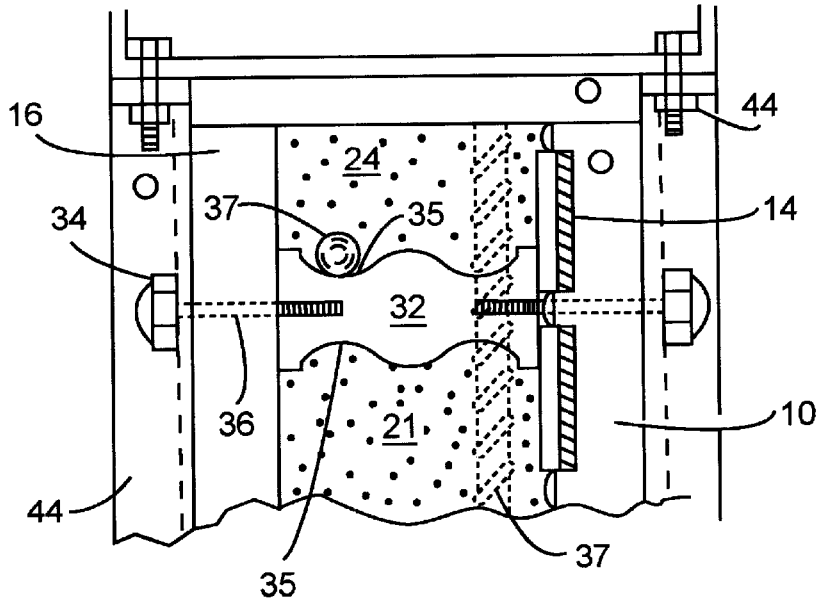
FIG. 2B is a cutaway end view of an ICF incorporating the surface panel shown in FIG. 1, this view being subsequent to a concrete pour, and showing the ICF being supported by a plastic paneling system. Additionally, this view shows the use of a sinusoidally shaped spacer functioning to hold sections of rebar in place inside the ICF.
Figure 2C:
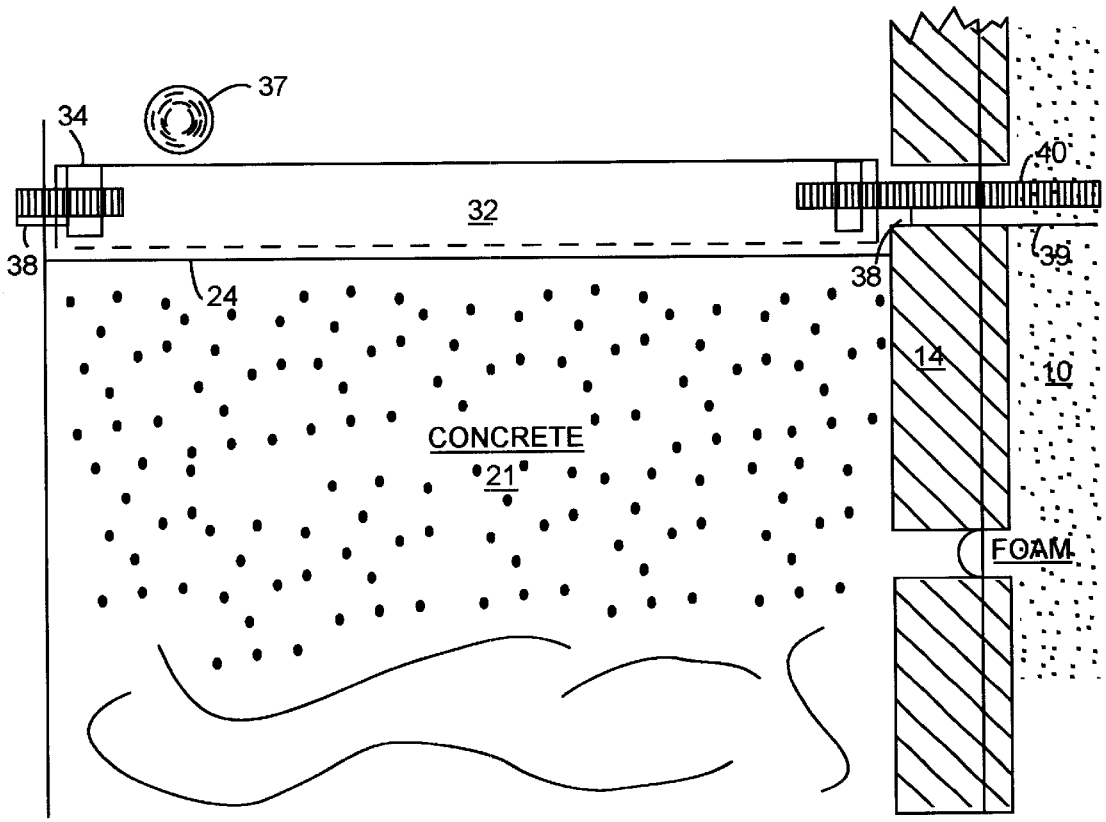
FIG. 2C is a cutaway end view of an ICF incorporating the surface panel shown in FIG. 1, this view being subsequent to a concrete pour and showing another spacer embodiment.

In FIG. 2A–C, the operation of surface panel 10 is illustrated by using bricks 14, however surface panel could be easily modified to accept stone, tile or siding motif components. FIGS. 2A–C, 3, 5 and 6 show bricks 14 placed within surface panel 10, with surface panel being used with a polystyrene interior panel 16 to complete an ICF system. In conjunction with surface panel 10, interior panel 16 completes a concrete form well 25 as shown. Interior panel 16 can be a plywood panel, another surface panel, or in the case of use with an ICF, a solid polystyrene panel having insulating properties.

In FIG. 1, it is seen that surface panel 10 includes an exterior surface 15, and an opposite interior surface 17 which includes a plurality of recessed bordered regions 18 the inside of these regions sized and shaped so as to snugly and formably hold a brick 14 therein, these bordered regions 18 collectively being patterned in a brick wall motif as shown. While the surface panel shown in FIG. 1 is that of a standard brick wall motif, surface panel 10 could be made to the specifications of a variety of different brick, stone, tile and siding motif components. Some examples of other common brick, stone, tile or siding motifs which are possible with this invention by modifying the shape of border regions 18, are shown in FIGS. 4*a–f*, these motifs being in no way inclusive. Surface panel 10 is preferably made of lightweight polystyrene which allows a variety of differently shaped border regions 18 to be easily molded into surface panel 10. Alternately, surface panel could be molded from steel or any of a variety of plastics, although this would add significant weight to surface panel.

Figure 5:
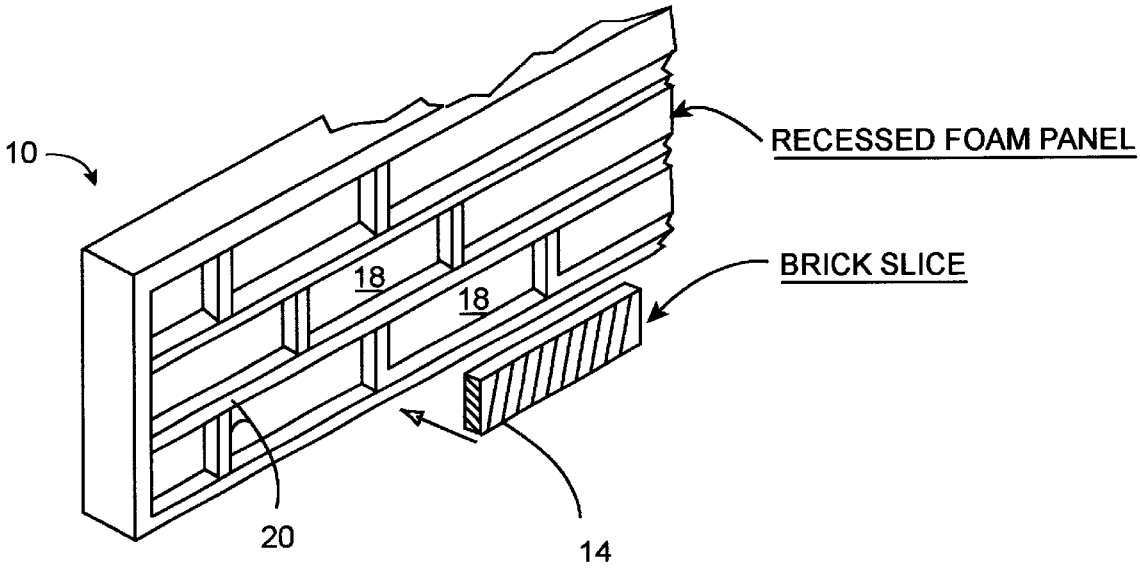
FIG. 5 is a perspective view of a portion of the interior side of an exterior panel showing a half-brick being inserted therein.

FIG. 5 shows a perspective view of a brick 14 being placed in a bordered region 18 of surface panel 10. Bordered regions 18 have raised borders 20 which hold bricks 14 therein by providing a snug frictional fit. However, to insure that bricks 14 do not fall out of the bordered regions 18 prior to, or during the pouring of concrete into the concrete form of which panel 10 is a part, a bonding glue is used to keep bricks 14 held fast. An example of a bonding glue which is used in accordance with the invention is that produced by A.P.I, Inc. of Albany, Calif. This glue is selected due to its propensity to deteriorate and release brick 14 from surface panel 10 within two days time. This time span has been found to be adequate to allow the concrete core of most structures built with surface panel 10 to dry sufficiently so as to allow removal of surface panel 10, thereby revealing a finished motif surface.

Figure 6:
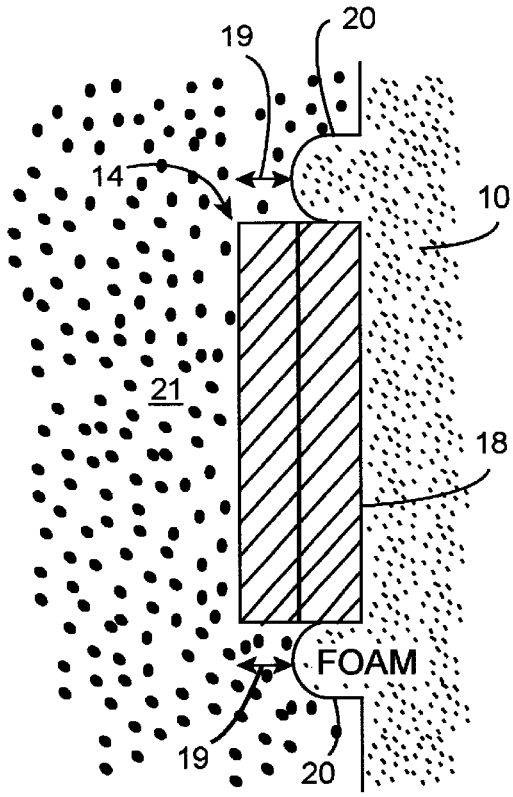
FIG. 6 is a closeup side cutaway view of an exterior panel shown with a half-brick snugly fitted into one of its bordered regions.

FIG. 6 shows a closeup side view of a brick 14 placed in a bordered region 18. As FIG. 6 shows, brick 14 is snugly and formably fit within bordered region 18 and protrudes above borders 20 a substantial distance 19 so as to expose sufficient surface area for contact with a pourable concrete mixture 21, the concrete mixture acting as a mortar for holding bricks 14 in place. Borders 20 protrude into the concrete mixture 21 and create mortar lines between adjacent bricks 14 in the finished structure.

FIGS. 5 and 6 illustrates a preferred type of half-brick 14 for use with surface panel 10. Half-brick 14 has a thickness of approximately 0.625", this thickness of half-brick 14 significantly reducing the weight and increasing the ease of retention of brick 14 within bordered regions 18 of surface panel 10. This thickness leaves approximately 0.375" protruding above borders 20 as surface area to be exposed to the pourable concrete mixture 21.

Figure 3:
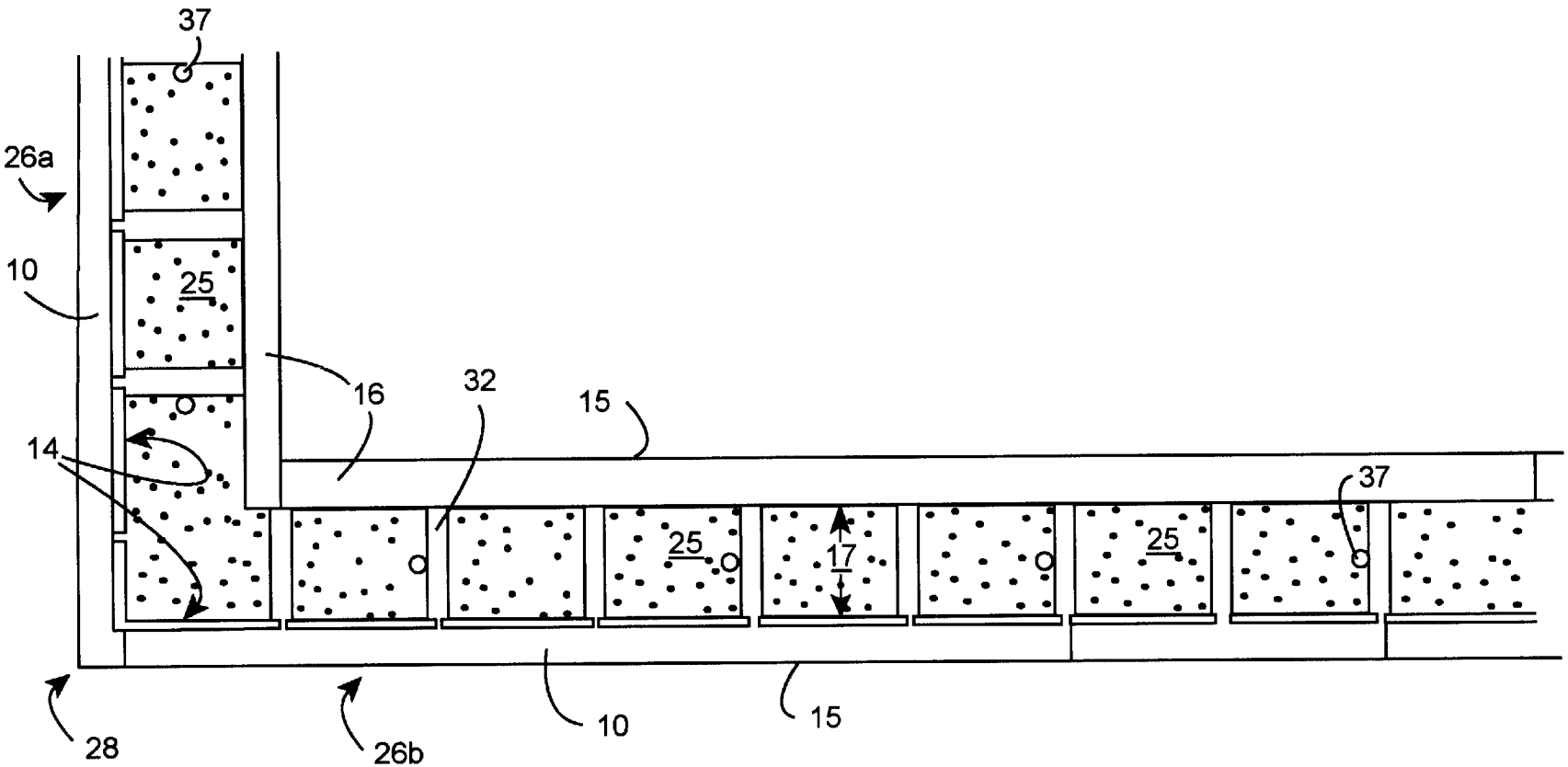
FIG. 3 is a plan view of a plurality of ICFs assembled for building a pair of adjoining walls, the view shown represents a first wall section set atop a foundation
Figure 4A:
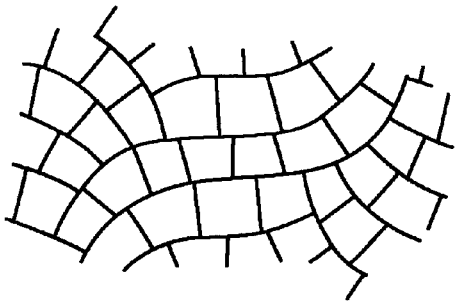
FIG. 4*a–f* are side views of different brick, tile, siding and stone motifs which can be created by modifying the surface panel shown in FIG. 1.
Figure 4B:
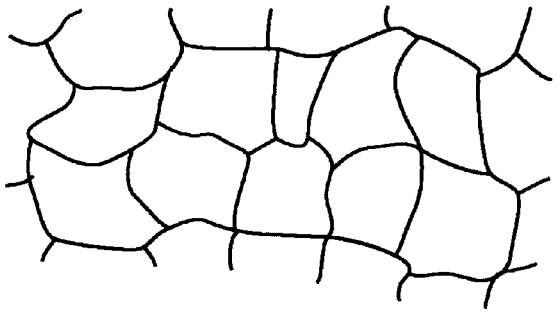
Figure 4C:
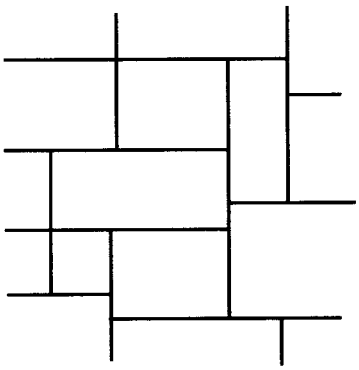
Figure 4D:
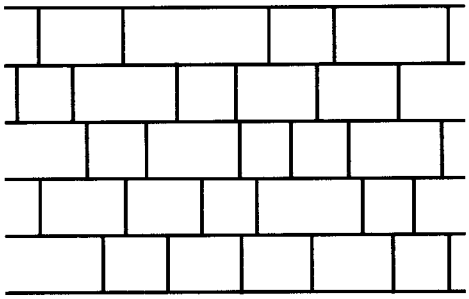
Figure 4E:
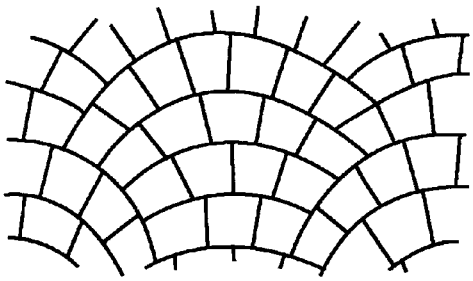
Figure 4F:
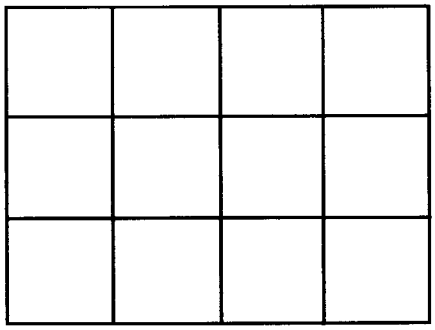
Figure 7:
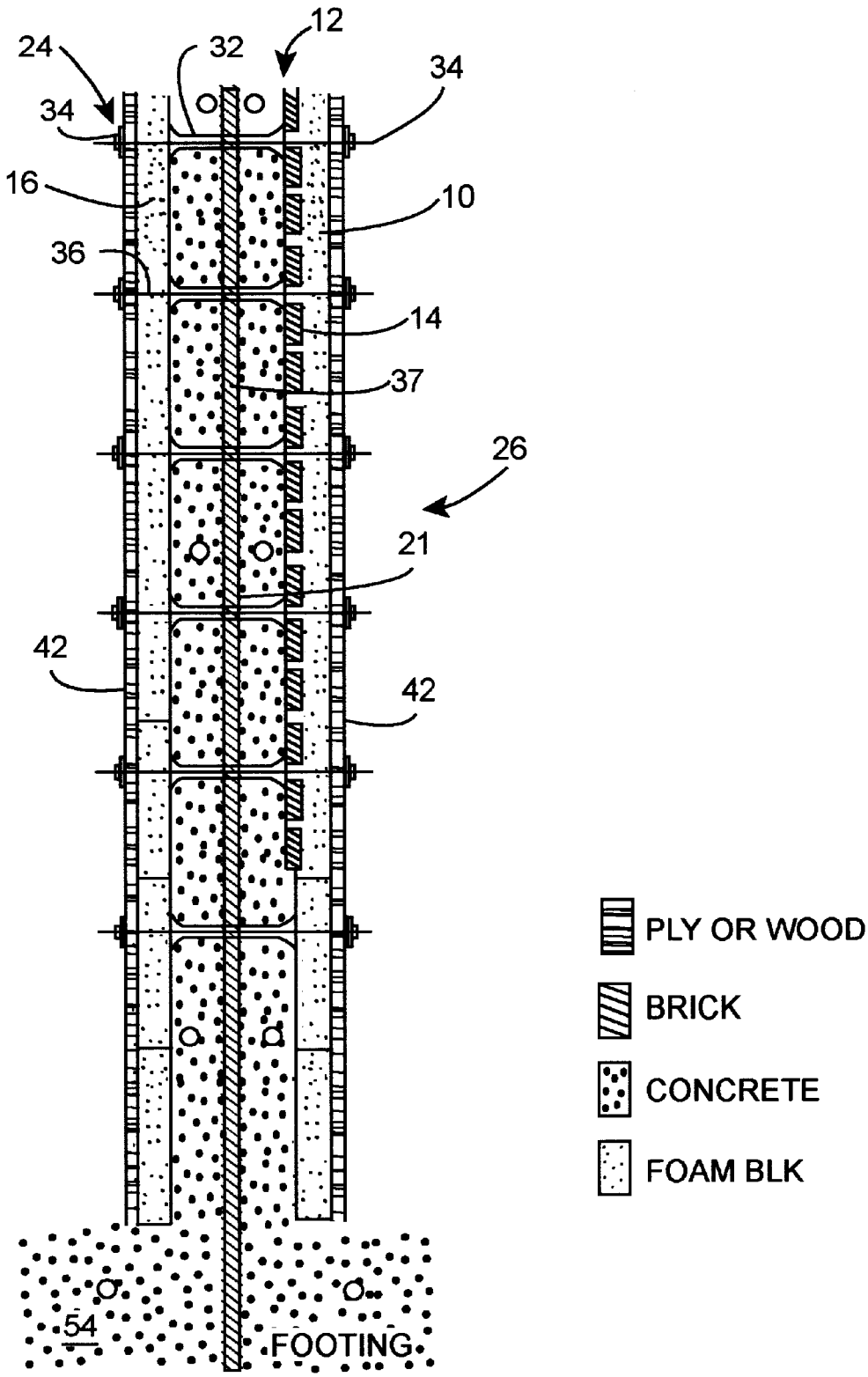
FIG. 7 is a cutaway end view of a completed brick and concrete wall built with the ICFs of the present invention, shown with the ICFs in placed and supported with plywood panels.

The usage of surface panel 10 in constructing a cement wall having a motif surface is best illustrated in FIGS. 3 and 7 which shows surface panel 10 being used with an ICF system 12. FIG. 2A illustrates a cutaway view of the ICF 12 shown in place and fully prepared for accepting a concrete pour. FIGS. 2B–C illustrate a cutaway view of ICF 12 after a concrete pour has occurred.

In its basic form, ICF 12 is comprised of a surface panel 10, an insulating interior panel 16, and at least one fastener 24 for holding the interior and surface panels 16,10 in a spaced relation so as to create a concrete form well 25 of preferably between 6"–12". For constructing an entire wall, a plurality of fasteners 24 positioned at spaced intervals, throughout a plurality of ICFs are required, as shown in FIG. 3, which illustrates a plan view of two walls 26*a–b* and their adjoining corner 28. FIG. 7 shows a cutaway of a completed wall 26, showing successively stacked ICFs 12. Such walls 26 can be adjoined until the outside perimeter walls of a house or commercial building are complete.

Interior panel 16 as well as surface panel 10 are preferably made from a lightweight, insulating, strong and disposable material, such as polystyrene foam. The preferred thickness of interior and surface panels is about two inches. Interior panel 16 remains as part of the insulating layer of a concrete structure, while surface panel 10 is removed and either discarded or reused, depending on its condition following removal. Also, the respective surface and interior panels 10, 16 can be shortened by merely cutting the polystyrene panels to an appropriate length to fit a particular application.

Interior panel 16 provides a soft surface for routering channels for running electrical and plumbing lines. In its insulating role, interior panel 16 provides an insulating factor of R-20, at two inches thickness. Higher insulating factors can be achieved by increasing the thickness of interior panel.

Figure 8A:
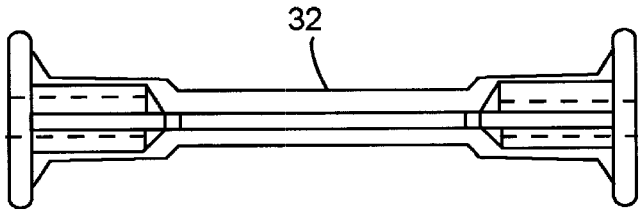
FIG. 8A is a side view of a first embodiment of a spacer portion of a fastener which holds the interior and surface panels of the ICF together.

Referring again to FIG. 2A and to FIG. 8A, fasteners 24 are shown in sufficient detail. Fasteners 24 are comprised of a spacer 32 which spans between interior and surface panels 16, 10 of ICF 12, and nuts 34 and bolts 36 which are screwed into spacer 32 from both of its ends, thereby holding interior and surface panels 16, 10 in place, in a perfectly spaced relation of between 6"–12".

Figure 8B:
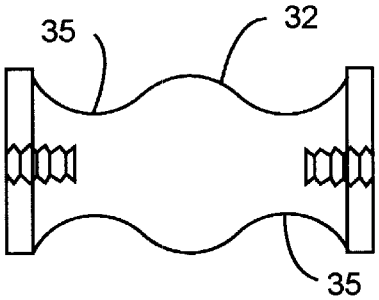
FIG. 8B is a side view of a second embodiment of a spacer portion having a sinusoidal shape for holding and spacing rebar as shown in FIG. 2B.

FIGS. 2B and 8B illustrates a second embodiment of spacer 32 having a sinusoidal shape for holding and spacing rebar 37 inside of an ICF. Often, during a concrete pour, the sheer hydraulic force of the concrete causes the rebar 37 to migrate to an improper position which does not allow its strengthening qualities to be maximized. The sinusoidal design of spacer 32 keeps rebar 37 positioned in small valleys 35, thereby holding rebar 37 stationary and at an optimum position for lending strength to an ICF wall. This embodiment of spacer 32 is preferably molded from high-impact plastic.

Figure 8C:
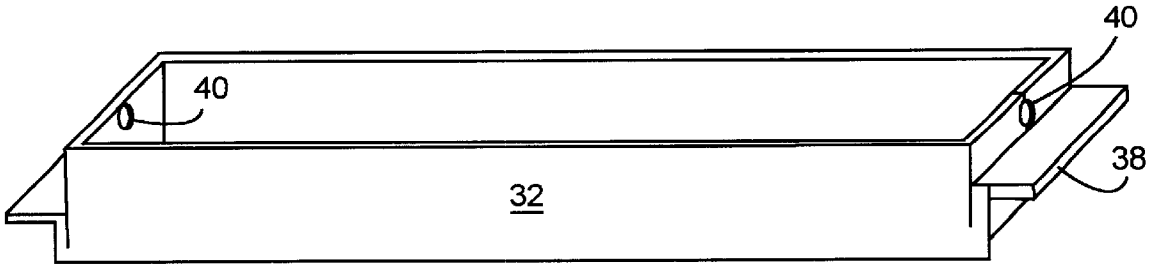
FIG. 8C is a side view of a third embodiment of a spacer portion designed for cheap manufacture and easy placement inside an ICF form as shown in FIG. 2C.

FIGS. 2C and 8C illustrate a third embodiment of spacer 32, this embodiment being of economical sheet metal construction and box-like in its design. A pair of ledges 38 protrude from opposite ends of spacer 32, these ledges for insertion in the spaces between adjacent ICF panels at their interlocking points 39. Ledges 38, allow for quick placement of spacers 32 by a set up crew. Upon being placed, spacer 32 suspends itself inside the interior of the ICF 12, and aligns itself with holes 40 in panels 10, 16 for placing bolts 36 for fastening to spacer 32.

Spacers 32 remain embedded in the dried concrete core of a wall and can be used to attach a number of items including cabinets, or even scaffolding to allow a higher wall to be built upon a completed lower wall section.

To add further integrity to ICF 10 during the drying phase of the concrete, plywood sheets 42 can be added to the outside of panels 10, 16 using fasteners 24 to hold them on, as illustrated in FIG. 7. Plywood sheets 42 prevent a common problem known as "blowout" where the concrete forces its way through the polystyrene as a result of hydraulic pressure.

As an alternative to plywood sheets 42, reinforced plastic panels 44 can be used as shown in FIGS. 9A–C. The advantage of plastic panels 44 is that they can be uniformly molded to create a standard paneling system for ICFs and bolted together at holes 43 to make any size concrete structure desired. Fasteners 24 connect at holes 45 plastic panels 44 also include ribs 46 to reinforce panels and allow them to be reusable over a longer life than plywood panels. Additionally, plastic does not adhere concrete, unlike plywood. Although not shown in the drawings, surface panel 10 and plastic side panel 44 could be combined into a single plastic unit if a reusable side panel is desired.

Figure 10:
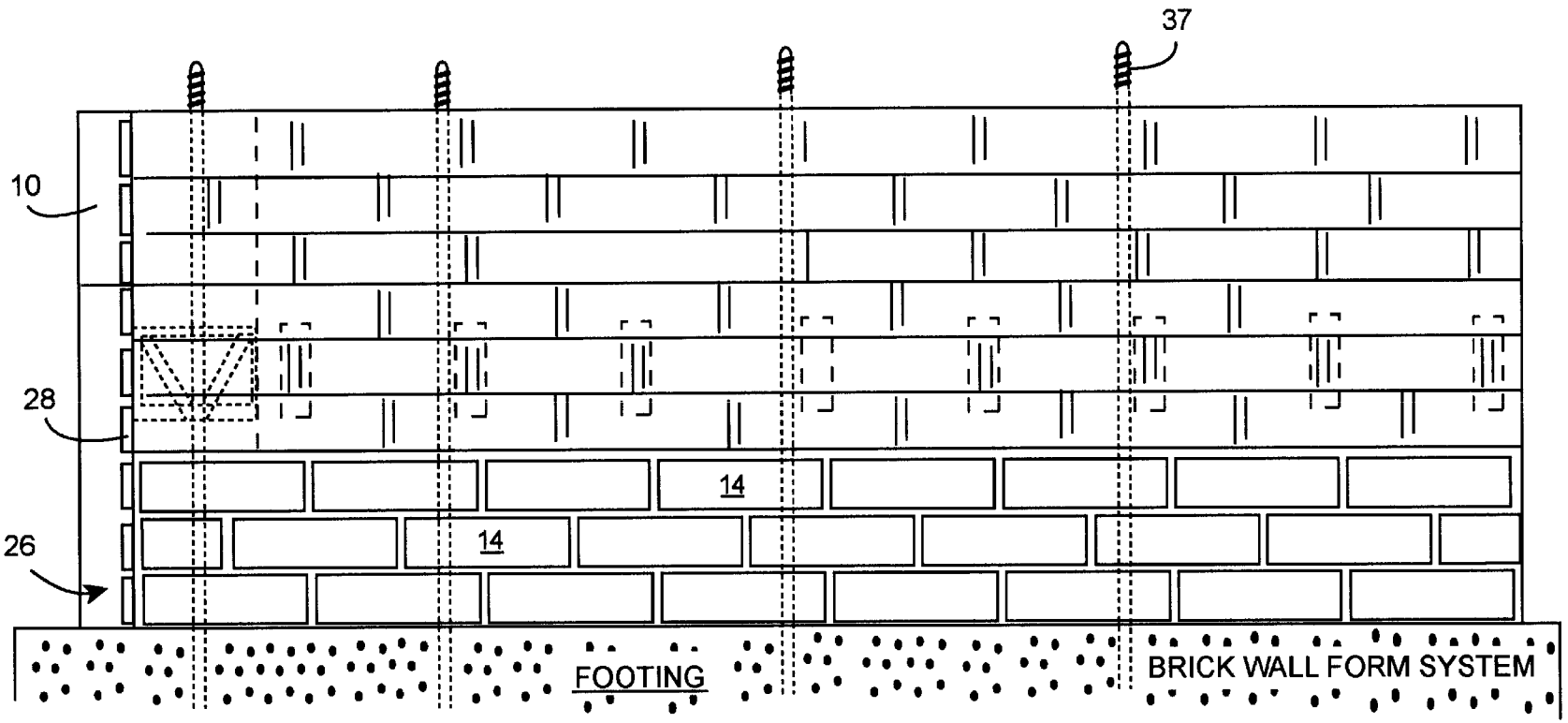
FIG. 10 is a side view of a completed brick and concrete wall built with the ICFs of the present invention, showing some of the interior features of the wall in phantom.
Figure 11:
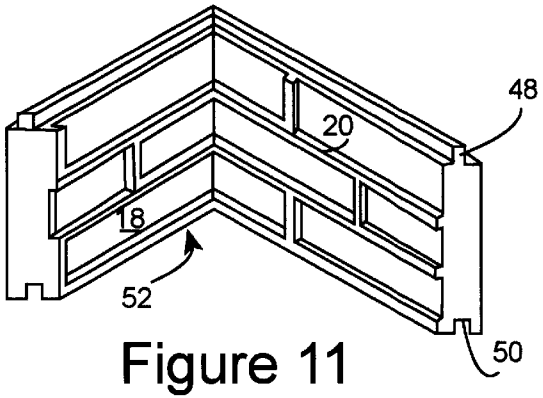
FIG. 11 is a perspective view of an surface panel corner section for an ICF of the present invention.

In an ICF 12, panels 10, 16 are approximately eight inches high and have tongues 48 and grooves 50 to allow for successive stackings of a plurality of ICFs, until a complete wall is formed. FIGS. 7 and 10 illustrate side views and cutaway end views of a wall 26 built in accordance with the invention. Corner areas 28 of adjoining walls 26 can be made using a corner section 52 as shown in FIG. 11, this corner section 52 being capable of stacking via tongue in groove coupling, as well.

If a brick structure is desired ICF 12 can construct a concrete and brick structure in approximately one third of the time it takes to build a similar structure using conventional masonry practices. Fewer laborers are required because the setup of the ICF panels 10,16 can be done by only a couple of individuals. Moreover, the skill level required to use this invention to build a concrete and brick structure is much lower than that required of a brick mason, thereby resulting in increased labor savings as well.

The method of using the ICF described herein involves first installing a conventional concrete foundation 54 wherein the foundation includes the addition of a notched element 56 running longitudinally along the top of the foundation 54. In FIG. 2A, this notched element 56 is shown, its purpose for mating in a tongue-in-groove manner with the first ICF 12 positioned on the foundation 52. Notched element 56 creates stability for ICF 12 and also prevents leakage of wet concrete from inside the ICF, to outside. Before concrete is poured into ICF 12, rebar 37 can be placed in the ICF in a conventional manner. Enough rebar should be used so that it protrudes above the finished wall; any excess can later be cut to the level of the uppermost surface of the finished wall.

Next, surface panel 10 is prepared next by gluing a half-brick 14 into each bordered region 18 until all the bordered regions are filled with half-bricks. Due to the weight savings provided by half-bricks 14, a surface panel filled with half-bricks can be easily lifted and set in place upon foundation 54, or else stacked upon other ICFs, by a single worker.

Once surface panel 10 is set in place, interior panel 16 is set opposite surface panel 10 and fasteners 24 are mounted and coupled in place with nuts and bolts 34, 36, completing the assembly of ICF 12. Fasteners 24 can be bolted to the surface and interior panels 10,16 directly, but as added insurance, a plywood or plastic panel 42, 44 as shown in FIGS. 7 and 9C, can be placed on the exterior surfaces 15 of each of the interior and surface panels, and bolted thereon, using fasteners 24 to bolt to.

Subsequent surface panels 10 can then be loaded with half-bricks 14, and stacked on top of the first layer of ICFs 12, via tongue-in-groove mating. Once a wall form is complete, concrete can be poured or piped in using a concrete crane, until the interior form well 25 is filled with wet concrete. ICF 12 holds each half brick in embedding contact with the wet concrete mixture which surrounds the exposed area of each half-brick 14 and fills the spaces between each half-brick 14 until it contacts the borders 20 of each bordered region 18. At this point, the half-brick is embedded in the concrete mixture wherein the mixture will dry and cement the half-brick solidly within the concrete core of the finished wall. The snug fit of half bricks 14 with bordered regions 18 effectively seals the exterior surface of half brick 14 from contact with the concrete. Referring again to FIG. 6 it is seen how the concrete surrounds the exposed areas of each half-brick 14.

When a wall has been completed using the ICF system, other walls of a structure can be completed in the same manner as just described, until the outer walls of a building are completed. Window openings can also be planned as part of the construction process at appropriate locations.

The concrete should sufficiently set after two days in a wall having an 6"–12" thickness, and surface panels 10 can be unbolted from fasteners 24 and removed from the finished brick wall 26 as illustrated in FIG. 10. If half-bricks 14 are used, the resulting appearance should be a brick wall exterior which is indistinguishable from a solid brick wall. Any cleanup required on the exterior of the wall can then be completed.

The interior panels 16 remain in place, although the plywood or plastic panels may be removed, if they are used. The Polystyrene interior panels can be easily routered with an appropriate router bit, to provide space for placing plumbing pipes, or electrical conduit. Alternately, in commercial and industrial buildings, the plumbing and electrical conduit can be set within the ICF prior to pouring; after pouring the plumbing and electrical are set permanently within the wall. Once the plumbing, electrical and gas are properly installed, the interior panels 16 can be finished with any variety of paneling, or sheetrock, depending on taste and usage. Subsequently, trusses, roofing and landscaping can be added to complete the structure.

Figure 12F:
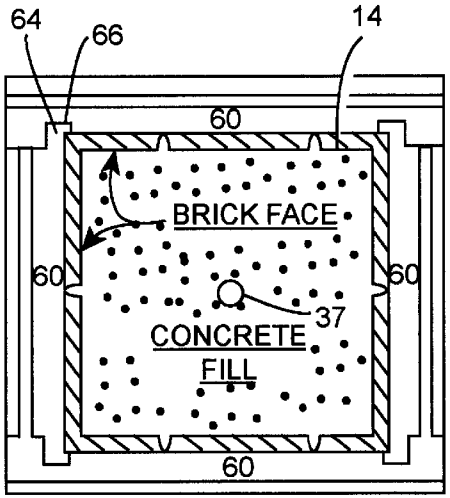
FIGS. 12 A–F are views of a concrete and brick pillar and associated surface panels used to make the pillar, in accordance with the invention.
Figure 12B:
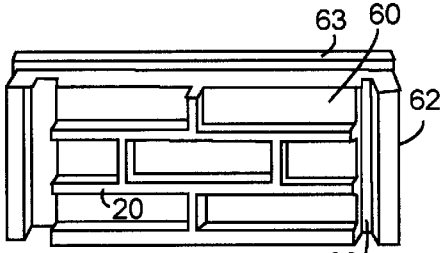
Figure 12C:
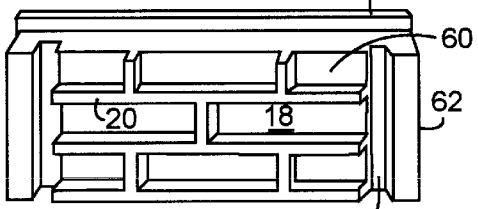
Figure 12D:
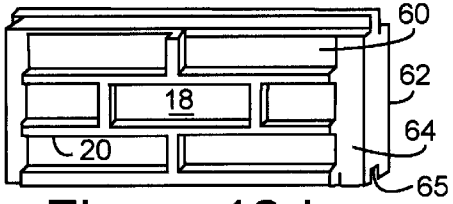
Figure 12E:
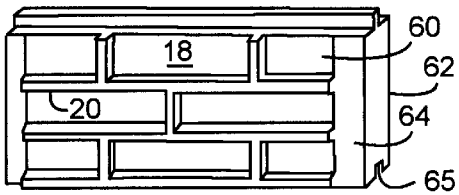
Figure 12A:
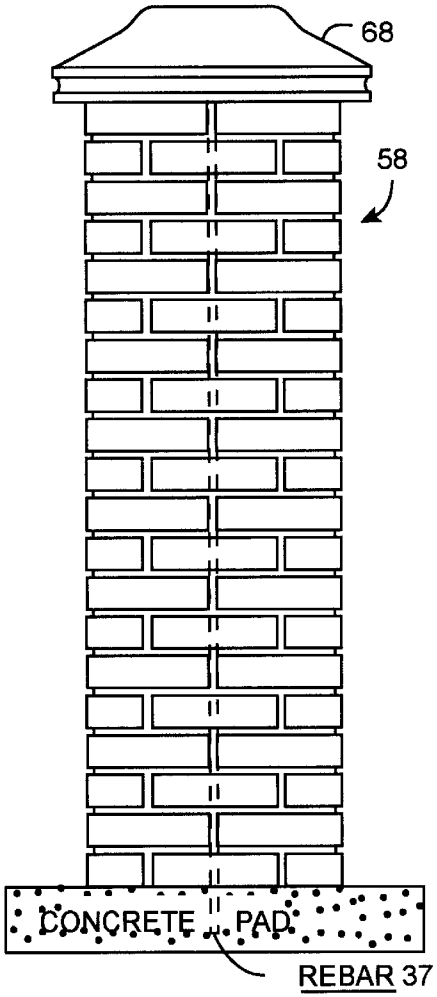

Referring now to FIGS. 12*a–f,* a brick and concrete pillar 58 is shown along with surface panels 60 used to construct pillar 58. As shown in FIGS. 12*b–e,* surface panels 60 interlock along their sides 62 via tounge-in-groove mating. The tongue and grooves 64, 66 along the sides of each panel 60 allow a stable form for pouring concrete to be created. Additional tongue and grooves 63,65 on the bottom and top of each panel 60 allow sections to be stacked until a desired height for a pillar is reached. In the preferred embodiment, each panel 60 is approximately 8 inches in height, wherein successive stackings allow a column of any usable height to be created. FIG. 12*f* shows a plan view of an assembly of four surface panels 60 having half-bricks 14 embedded into the bordered regions 18 of each panel 60. Upon stacking successive surface panels, rebar 37 can be placed inside to reinforce the finished pillar 58. Concrete is then poured and allowed to dry, thereby embedding the half-bricks 14 and creating a finished pillar 58 of the type shown in FIG. 12*a*. A decorative cap 68 can then be added to the column to give it even more aesthetic appeal.

Figure 13:
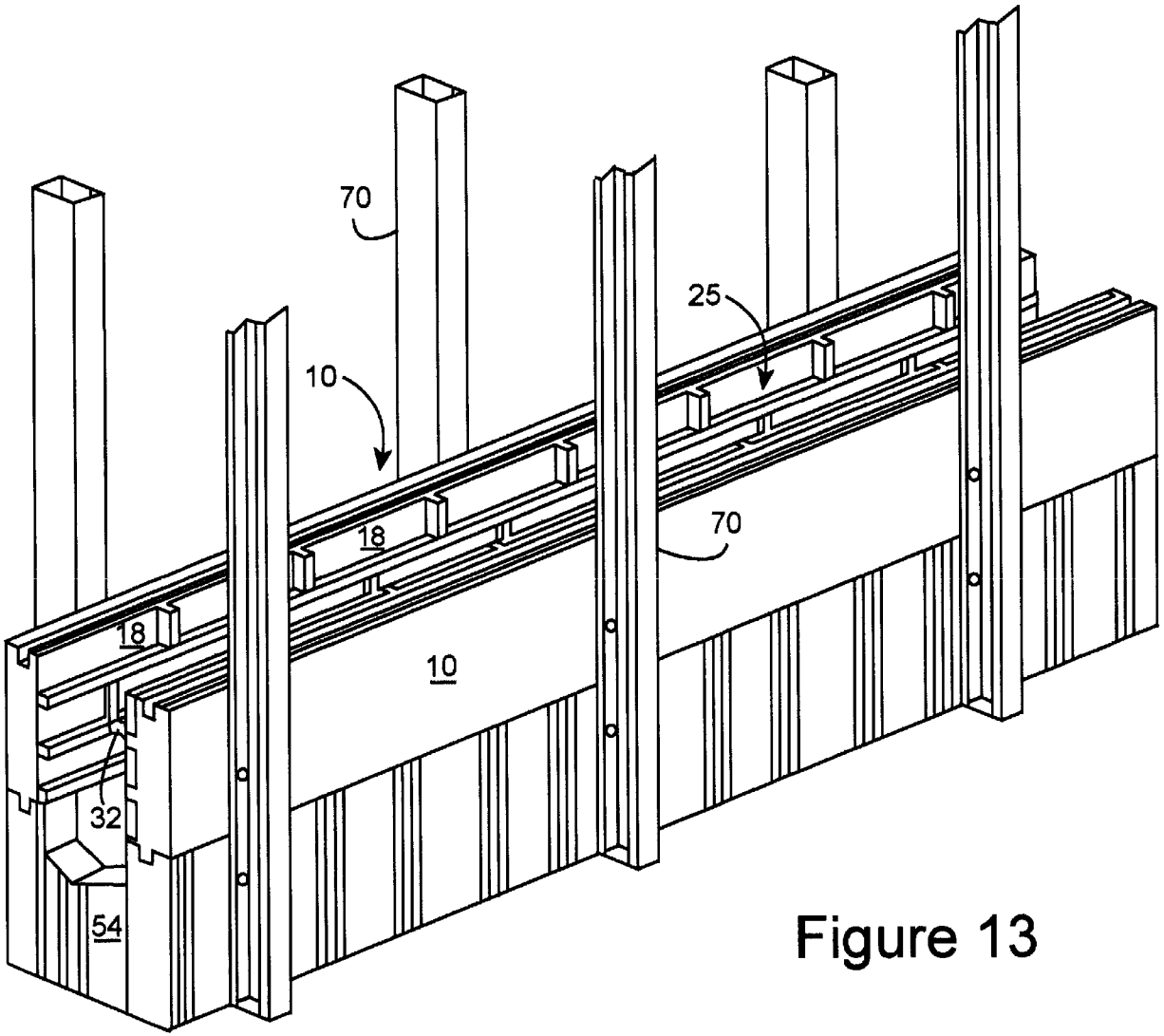
FIG. 13 is an elevated perspective view of surface panels being used to construct a two-sided wall having a brick motif.

Finally, FIG. 13 shows surface panels 10 being used to create a high wall 26 wherein both sides of the wall have a brick exterior motif. As shown, two surface panels 10 atop foundation 54 face each other from opposite sides of the form well 25. Spacers 32 separate the panels as previously described. Girders 70 are placed next to the surface panels 10 to provide added support as wall 26 is built higher with successive stackings of surface panels 10. Surface panels 10 are loaded with half-bricks 14 and then form well 25 is filled with concrete.

Accordingly, it will be seen that this invention provides for a surface panel for creating any one of a number of decorative and utilitarian surface motifs on concrete structures. This surface panel can be used alone, in conjunction with other surface panels, or in conjunction with an ICF system for building a variety of concrete structures which are decorative, utilitarian, and which do not require costly skilled labor. Finally, although the description above contains many specificities, these should not be construed as limiting the scope of the invention but as merely providing illustrations of some of the presently preferred embodiments of this invention.

What is claimed is:

1. An insulating surface panel for creating concrete structures having motif components imbedded in a surface thereof, said surface panel comprising:

a) an exterior surface;

b) a plurality of motif components, each of said plurality of motif components having a front part and a back part;

c) an adhesive; and d) an interior surface opposite from said exterior surface for contacting a pourable concrete mixture, said interior surface comprising a plurality of recessed regions separated by borders, each of said plurality of recessed regions being sized and shaped to conform to the front part of one of said plurality of motif components, wherein the front part of each of said plurality of motif components is glued into one of said plurality of recessed regions which conforms to the motif component's front part, with said adhesive, such that the back part of each motif component protrudes beyond said interior surface; and wherein said insulating surface panel is composed of an insulating foam, whereby each motif component is tightly secured in said insulating surface panel and the front part of each motif component is protected from contact with concrete.

2. The insulating surface panel of claim 1 wherein said insulating foam comprises polystyrene.

3. The insulating surface panel of claim 2 wherein said adhesive is a quickly deteriorating glue which deteriorates and releases each of said motif components from said insulating surface panel in about two days.

4. The surface panel of claim 3 further comprising a tongue along a first surface and a groove along a second surface, whereby a plurality of surface panels may be stacked.

5. The surface panel of claim 4 wherein said recessed regions comprise a rectangular planar bottom surface surrounded by substantially vertical boarders.

6. The surface panel of claim 5, wherein said plurality of motif components are bricks.

7. An insulating concrete form for creating a motif on at least one surface of a concrete structure when concrete is poured into the insulating concrete form, said insulating concrete form comprising:

a) an insulating interior panel, said insulating interior panel composed of an insulating foam and said insulating panel being oriented vertically;

b) an insulating surface panel positioned vertically and opposite from said insulating interior panel, said insulating surface panel composed of an insulating foam, comprising i) an exterior surface, ii) a plurality of motif components, each of said plurality of motif components having a front part and a back part, iii) an adhesive; and iv) an interior surface opposite from said exterior surface for contacting a pourable concrete mixture, said interior surface comprising a plurality of recessed regions separated by borders, each of said plurality of recessed regions being sized and shaped to conform to the front part of one of said plurality of motif components, wherein the front part of each of said plurality of motif components is glued into one of said plurality of recessed regions which conforms to the motif component's front part, with said adhesive, such that the back part of each motif component protrudes above said interior surface; whereby each motif component is tightly secured in said insulating surface panel and the front part of each motif component is protected from contact with concrete;

c) at least one spacer positioned between said insulating interior panel and said insulating surface panel to hold said insulating interior panel and said insulating surface panel in uniform spaced relation; and d) a plurality of fasteners attached to said at least one spacer and extending through said insulating exterior panel and said insulating surface panel so as to hold said insulating interior panel and said insulating surface panel together to form a well for pouring a concrete mixture therein.

8. The insulating concrete form of claim 7 wherein said insulating foam comprises polystyrene.

9. The insulating surface panel of claim 8 wherein said adhesive is a quickly deteriorating adhesive which deteriorates and releases each of said motif components from said insulating surface panel in about two days.

10. The insulating concrete form of claim 9 further comprising a first support panel disposed outside of said insulating surface panel and a second support panel disposed outside of said insulating interior panel such that said first support panel is held in place by at least one of said plurality of fasteners and said second support panel is held in place by at least one of said plurality of fasteners, whereby said first support panel and said second support panel provide structural strength to said insulating concrete form.

11. The insulating concrete form of claim 10 wherein said at least one spacer is sinusoidally shaped so as to provide a guide for positioning reinforcing bars within the valleys of said at least one spacer.

12. The insulating concrete form of claim 10 wherein said insulating interior panel comprises:

a) a second exterior surface, b) a second plurality of motif components, each of said second plurality of motif components having a front part and a back part, c) an adhesive; and d) a second interior surface opposite from said second exterior surface for contacting a pourable concrete mixture, said second interior surface comprising a second plurality of recessed regions separated by borders, each of said second plurality of recessed regions being sized and shaped to conform to the front part of one of said second plurality of motif components, wherein the front part of each of said second plurality of motif components is glued into one of said second plurality of recessed regions which conforms to the one motif component's front part, with said adhesive, such that the back part of each of said second plurality of motif components protrudes above said second interior surface, whereby the front part of each of said second plurality of motif components is protected from contact with concrete, and whereby said insulating concrete form creates a concrete structure with motif components imbedded on two surfaces when concrete is poured into the form.

13. The insulating concrete form of claim 10 wherein said first support panel and said second support panel are chosen from the group consisting of plywood sheets and reinforced plastic panels.

14. A method for casting in place a vertical concrete structural wall with at least one surface decorated with motif components imbedded therein comprising the steps of:

a) erecting an insulating concrete form in position to cast said vertical structural wall, said insulating concrete form comprising i) an insulating interior panel composed of an insulating foam, ii) an insulating surface panel composed of said insulating foam, positioned opposite said insulating interior panel, said insulating surface panel comprising an exterior surface, and an interior surface opposite from said exterior surface for contacting a pourable concrete mixture, said interior surface comprising a plurality of recessed regions separated by borders, iii) at least one spacer positioned between said insulating exterior panel and said insulating surface panel to hold said insulating exterior panel and said insulating surface panel in uniform spaced relation, and iv) a plurality of fasteners attached to said at least one spacer and extending through said insulating exterior panel and said insulating surface panel so as to hold said insulating interior panel and said insulating surface panel together to form a well for pouring a concrete mixture therein;

b) gluing a plurality of motif components, each motif component having a front part and a back part, into said recessed regions of said interior surface of said insulating surface panel with an adhesive, wherein the front part of each of said plurality of motif components is glued into one of said plurality of recessed regions such that it is formably held within the one region into which it is glued, and such that the back part of each motif component protrudes above said interior surface;

c) filling the well of said insulating concrete form with a pourable concrete mixture to form the structural wall therein;

d) allowing said pourable concrete wall to cure in place;

e) removing said insulating surface panel to reveal a wall surface with motif components imbedded therein.

15. The method of claim 14 wherein said insulating foam comprises polystyrene.

16. The method of claim 15 wherein said adhesive is a quickly deteriorating adhesive which deteriorates and releases each of said motif components from said insulating surface panel in about two days.

17. The method of claim 16 wherein;

a) said insulating interior panel comprises a second exterior surface, and a second interior surface opposite from said second exterior surface for contacting a pourable concrete mixture, said second interior surface comprising a second plurality of recessed regions separated by borders; and b) wherein the method further comprises the steps of:

i) gluing a second plurality of motif components, each of said second plurality of motif components having a front part and a back part, into said recessed regions of said second interior surface of said insulating interior panel, wherein the front part of each of said second plurality of motif components is glued into one of said second plurality of recessed regions such that it is formably held within the one recessed region into which it is glued, and such that the back part of each of said second plurality of motif components protrudes above said second interior surface, and ii) removing said insulating panel after said pourable concrete wall has cured to reveal a second surface of said wall with motif components imbedded therein.

18. A concrete wall constructed according to the method of claim 15.

* * * * *